US006572448B1

(12) United States Patent
Bauer

(10) Patent No.: US 6,572,448 B1
(45) **Date of Patent: *Jun. 3, 2003**

(54) COMBINATION BLADE SHARPENER AND CURVED OR STRAIGHT EDGE BLADE

(75) Inventor: Gerd F. Bauer, Waldo, WI (US)

(73) Assignee: Magna-Matic Corporation, Waldo, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/116,935

(22) Filed: Apr. 5, 2002

Related U.S. Application Data

(63) Continuation-in-part of application No. 09/476,350, filed on Jan. 3, 2000, now Pat. No. 6,368,196.

(51) Int. Cl.[7] ..... B24B 1/00
(52) U.S. Cl. ..... 451/29
(58) Field of Search ..... 451/293, 193, 451/203, 321, 223, 45; 83/174.1, 174

(56) References Cited

U.S. PATENT DOCUMENTS 4,528,777 A * 7/1985 Bernstein et al. ..... 51/40
5,329,731 A * 7/1994 Wall ..... 51/98 BS
6,364,750 B2 * 4/2002 Bauer ..... 451/45
6,368,196 B1 * 4/2002 Bauer ..... 451/293

* cited by examiner

*Primary Examiner*—Lee D. Wilson
(74) *Attorney, Agent, or Firm*—Donald Cayen

(57) ABSTRACT

A blade sharpener comprises a work surface consisting of a single support line. A grinding wheel defines a transverse plane that contains the support line. The grinding wheel is swingable in the transverse plane to a selected position relative to the support line. A blade is supported on the support line with the blade cutting edge perpendicular to the support line. The single support line enables a mulching blade to be sharpened without having to impart angular motions in space to it as it is fed past the grinding wheel. Swinging the grinding wheel to different positions relative to the support line enables it to produce different cutting surfaces on the blades. Swinging of the grinding wheel is achieved by mounting it to a plate that pivots about an axis perpendicular to the grinding wheel transverse plane. A mobile work table is selectively retainable over and removable from the support line support.

12 Claims, 8 Drawing Sheets

COMBINATION BLADE SHARPENER AND CURVED OR STRAIGHT EDGE BLADE

This is a continuation-in-part of U.S. patent application Ser. No. 09/476,350 filed Jan. 3, 2000 now U.S. Pat. No. 6,368,196.

BACKGROUND OF THE INVENTION

1. Field of the Invention

This invention pertains to sharpening equipment, and more particularly to apparatus that sharpens a wide variety of cutting blades.

2. Description of the Prior Art

Rotary power mowers of various types are well known and are in widespread use. They vary greatly in size, complexity, and operating characteristics. However, all rotary power mowers utilize the common component of a rotary cutting blade. The blades are relatively long, narrow, and thin. A cutting edge is sharpened into each end of the blade. As the blade rotates under power from the mowing machine, the cutting edges shear vegetation.

The cutting edges of some rotary blades lie along substantially straight lines for their full lengths. A typical example of such a blade is shown at reference numeral 3 in FIGS. 1–3. The blade 3 has a longitudinal centerline 4 and a flat bottom surface 6, and opposed ends 34. There are a pair of cutting edges 8 at the ends 34, both of which lie along straight lines 10 that are substantially parallel to the longitudinal centerline 4. The cutting edges 8 and the straight lines 10 coincide. The blade further has back edges 2 opposite the cutting edges 8, and a top surface 80 opposite the bottom surface Each cutting edge 8 is defined by the junction of the blade bottom surface 6 and a cutting surface 12. The cutting surfaces 12 intersect the top surface 80. The bottom surface 6 and cutting surface 12 subtend a cutting angle L. Each cutting edge 8 intersects an end 34 of the blade 3 at a tip 38. The tips 38 are especially important, because they are the portions of the blade that first come into contact with the vegetation being cut by the blade. There are an infinite number of imaginary lines 14 along the blade bottom surface 6 between each cutting edge 8 and the corresponding back edge 2. Flat blades such as the blade 3 are used to shear vegetation and expel it tangentially away from a mowing machine.

Other cutting blades have cutting edges that are not straight but instead lie along curved lines. The curved cutting edges are particularly useful for mulching the vegetation in addition to shearing it and expelling it. FIGS. 4–7 show a typical mulching blade 16 having five sections: a relatively long center section 26, a pair of angled sections 28 that slope downwardly and away from the ends of the center section 28, and a pair of end sections 30 on the ends of the angled sections 28. The end sections 30 lie in a plane that is substantially parallel to the plane of the center section 26. The center section has a bottom surface 22, the angled sections have respective bottom surfaces 48, and the end sections 30 have respective bottom surfaces 49. The center section has a top surface 84, the angled sections have respective top surfaces 86, and the end sections have respective top surfaces 88. The mulching blade defines a longitudinal centerline 92.

The mulching blade 16 further has curved cutting edges 18. Each cutting edge 18 lies along a respective curved line 20. The cutting edges 18 and lines 20 are generally parallel to the centerline 92 and are defined by the junctions of the bottom surfaces 22, 48, 49 of the blade sections with associated cutting surfaces 24. The cutting surface 24 intersects the top surfaces 84, 86, and 88. The cutting edges 18 also intersect the ends 40 of the mulching blade at tips 42. There are an infinite number of imaginary lines 32 on the mulching blade bottom surfaces between the cutting edges 18 and the back edges 90 of the blade opposite the cutting edges.

A routine task associated with rotary power mowers is sharpening the blades. For that purpose, a variety of mechanized equipment has been developed. For example, a division of Wall Enterprises, Inc. of New Whiteland, Ind., markets rotary blade grinding machines. Magna-Matic Corporation of Waldo, Wis., is a manufacturer of blade grinding and balancing machines.

Prior blade sharpening machines have not been entirely satisfactory. For one reason, they generally have been limited to sharpening blades with straight cutting edges, i.e., flat blades such as blade 3 depicted in FIGS. 1–3. That is because the prior machines had flat work surfaces of substantial area and lying in a single plane. The blades were supported on the work surfaces and manually fed lengthwise, i.e., parallel to the longitudinal centerline 4 of the blade 3, while in contact with a grinding wheel. The flat area of the work surface was satisfactory for straight edge blades, because no angular movements of the blade in space relative to the grinding wheel were required to grind the cutting edge.

On the other hand, the flat area work surfaces of prior blade sharpeners presented considerable difficulty with mulching blades, such as mulching blade 16 of FIGS. 4–7. That was because the mulching blade curved edges 18 required that the blades be fed crosswise in addition to lengthwise in order to properly grind the curved cutting edges. Simultaneous crosswise and lengthwise feeding of the blades was difficult to do, especially at the transitions between the various sections, such as the transitions between the center section 22 and the angled sections 28, and the transitions between the angled sections and the end sections 30. The prior sharpeners used relatively wide grinding wheels, such as one inch, which exacerbated the problem. Moreover, with a flat work surface of substantial area, the curved cutting edges of the different sections contacted the grinding wheel at different angular locations on the grinding wheel periphery. As a result, the cutting angles of the cutting edges at the different blade sections varied considerably. A uniform cutting angle was possible only by carefully imparting angular motions to the blade while lengthwise and crosswise feeding it.

An associated problem with the large flat work surface of a prior machine was that the work surface was cut out to make room for the grinding wheel. The work surface was therefore rather limber and prone to vibrate and create excessive noise during operation. A related problem with the cutout in the work surface was that the blade cutting edge was not supported directly in line with the transverse plane of the grinding wheel. It was very difficult to properly grind the tips of a blade using such a machine, because the cutting force of the grinding wheel required the operator to provide a resisting force. Even if the operator did not yield to the cutting force, the blade itself could bend because it was only cantilever supported by the work surface. Since the tips of the cutting edges are the most important part of the blade, any error in grinding the tips was quickly reflected in substandard mowing machine performance.

U.S. Pat. No. 5,329,731 shows an attachment for a grinding machine that facilitates sharpening mulching blades. The attachment has two flat work surfaces, each of substantial area, along which a blade is fed. However, the flat large area work surfaces limit the attachment's usefulness when sharpening mulching blades having certain contours. In fact, some style mulching blades can not be sharpened at all when using the attachment of the U.S. Pat. No. 5,329,731. For some other mulching blades, even using the attachment of the U.S. Pat. No. 5,329,731 produces varying cutting angles on the blade cutting edges along different sections of the blade.

Yet another deficiency of prior sharpening machines concerns the grinding wheels and their mountings. In prior machines, the grinding wheels were mounted directly to the armature shafts of electric motors. Accordingly, the grinding speed was limited to the motor speed. However, many grinding wheels are capable of cutting at higher speeds than conventional motor speeds. Hence, the full cutting capabilities of the grinding wheels were not used. A related problem concerns the composition of the grinding wheels used with prior blade sharpeners. To compensate for the lower production obtained by, slower than usable grinding wheel speeds, prior sharpeners used harder than necessary grinding wheels. Such grinding wheels tended to burn rather than cut the metal from the blades. Further, the excessively hard grinding wheels easily loaded up with steel particles from the blades. Consequently, the grinding wheels had to be dressed periodically, which resulted in unproductive time.

Perhaps the biggest problem with prior blade grinding machinery was the lack of ability to grind blades of any length and configuration. For example, the grinding machine shown in U.S. Pat. No. 5,329,731 has upstanding posts that restrict lengthwise and even crosswise feeding of a blade past the grinding wheel. Consequently, the sizesand types of blades sharpenable on that machine are limited.

Thus, a need exists for improvements in blade grinding machines.

SUMMARY OF THE INVENTION

In accordance with the present invention, a blade sharpener is provided that is capable of properly and efficiently grinding both curved and straight edge blades without restriction. This is accomplished by apparatus that includes a work surface that supports a blade only along a single straight line that lies in the transverse plane of a grinding wheel and that is perpendicular to the blade cutting edge.

According to one aspect of the invention, the support line is a longitudinal line along a cylindrical surface on the top of a pedestal. The pedestal is mounted to a base that defines a base plane. The pedestal defines a pedestal plane that is perpendicular to the base plane and that passes through the support line. The pedestal plane is coplanar with the grinding wheel transverse plane.

A pivot plate is connected to the base for pivoting about a first axis. An electric motor and the grinding wheel are secured to the pivot plate. The grinding wheel axis of rotation is perpendicular to the support line and parallel to the base plane. The grinding wheel is relatively narrow, and it is driven by the motor. An adjustment mechanism pivots the pivot plate to adjust the position of the grinding wheel relative to the work surface, but the support line remains in the transverse plane of the grinding wheel for all positions of the pivot plate.

To use the blade sharpener, the pivot plate is adjusted to bring the grinding wheel periphery close to the work surface. A blade to be sharpened is oriented such that its longitudinal centerline is generally horizontal and perpendicular to the work surface and parallel to the grinding wheel axis of rotation. The blade cutting edge is also perpendicular to the work surface. The bottom surface at the end of the blade is placed on the work surface. The blade is fed crosswise, i.e., in a direction perpendicular to its longitudinal centerline and perpendicular to the grinding wheel axis of rotation, into contact with the grinding wheel periphery such that the cutting edge at the blade tip is sharpened. The support by the work surface directly under or very close to the cutting edge at the blade tip minimizes any problems associated with sharpening the tip. The blade is then fed lengthwise, i.e., parallel to its longitudinal centerline and perpendicular to the grinding wheel axis of rotation, along the work surface past the grinding wheel periphery, all the while being supported only by the single support line of the work surface. When an angled section of the blade, and the corresponding curve in the cutting edge, reaches the work surface, the single support line enables the blade to rise and fall relative to the grinding wheel while keeping the blade cutting edge always in contact with the grinding wheel and always supported directly in line with the grinding wheel. In that manner, blades of a wide variety of contours and cutting edges can be efficiently sharpened.

Further in accordance with the present invention, blades having cutting edges of unlimited length are sharpenable. The blade sharpener has no posts or other members that restrict the length of the blade cutting edge. Similarly, there is no crosswise restriction in the access of the blade to the grinding wheel.

It is a further feature of the invention that it takes full advantage of modern grinding wheel technology. As one example, the production rates available from high grinding wheel speeds now available are utilized by means of an updrive between the motor and the grinding wheel. Consequently, rather than being limited to the speed of the motor, the grinding wheel is rotated approximately 20 percent faster than in prior blade sharpening machines. At the same time, the grinding wheel has a hardness only slightly greater than that of steel blades. The combination of the relatively soft grinding wheel and higher grinding wheel speed results in rapid and clean cutting of the blade during the sharpening process. The tendency of burning metal, rather than cutting it, from the blade that results from using the prior hard grinding wheels at slower speeds, is eliminated. In addition to having higher production, the blade sharpener of the invention eliminates the need for a grinding wheel dresser.

According to another aspect of the invention, a flat work surface of substantial area is interchangeable with the single support line work surface. For that purpose, a mobile work table has a top plate from which depend a pair of parallel lugs. The lugs are spaced apart a distance slightly greater than the width of the pedestal that includes the single line work surface. A clamp is joined to the lugs. By placing the mobile work table over the pedestal and actuating the clamp, the large area flat work surface is retained on the blade sharpener The mobile work table finds use when sharpening flat workpieces such as straight rotary mower blades.

The method and apparatus of the invention, using a work support surface consisting of a single line, thus sharpens mulching blades in an efficient manner. The single support line enables blades of practically any size and contour to be sharpened, even though the cutting edges of the blade are perpendicular to the support line.

Other advantages, benefits, and features of the present invention will become apparent to those skilled in the art upon reading the detailed description of the invention.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 2:
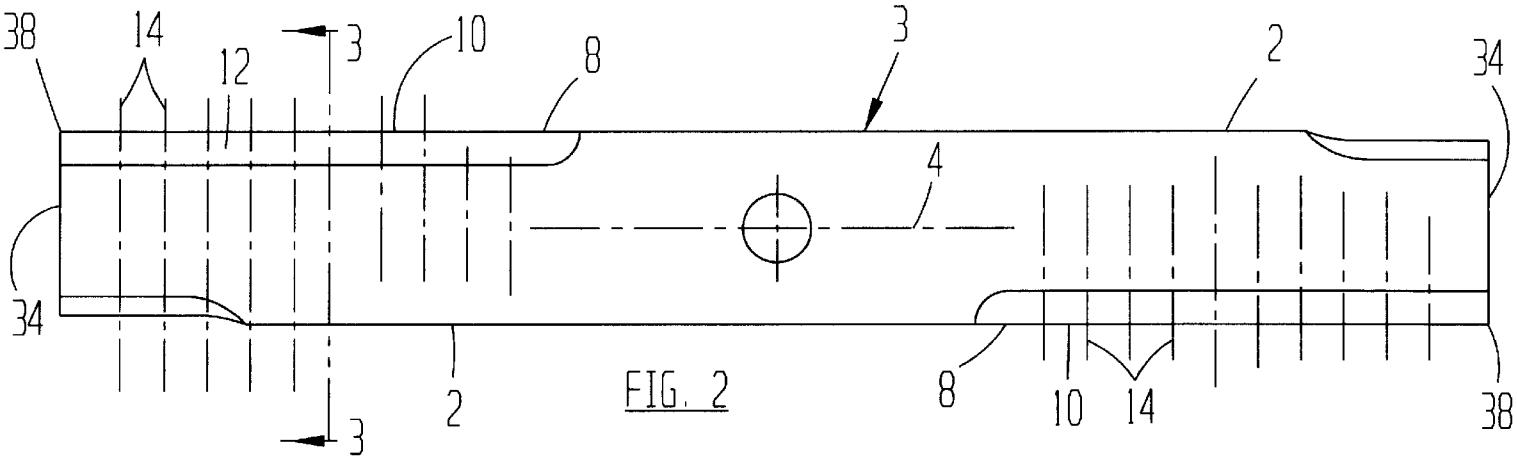
FIG. 2 is a top view of FIG. 1.
Figure 1:
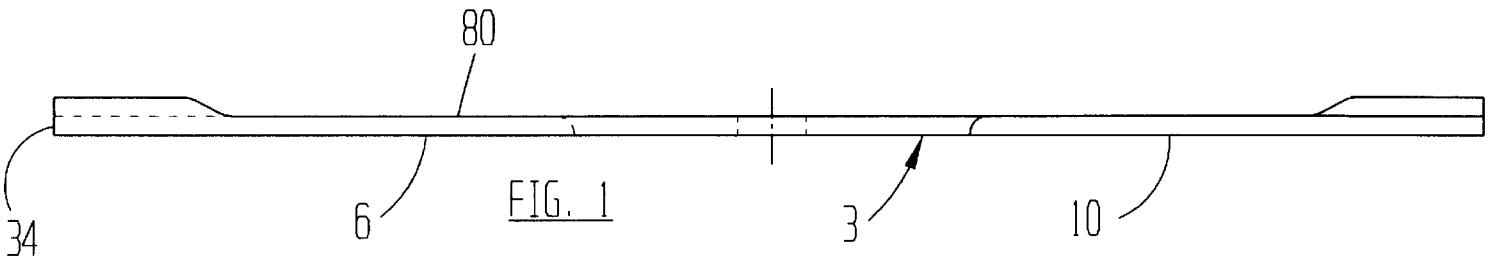
FIG. 1 is a front view of a typical straight cutting blade that is advantageously sharpened by the blade sharpener of the present invention.
Figure 8:
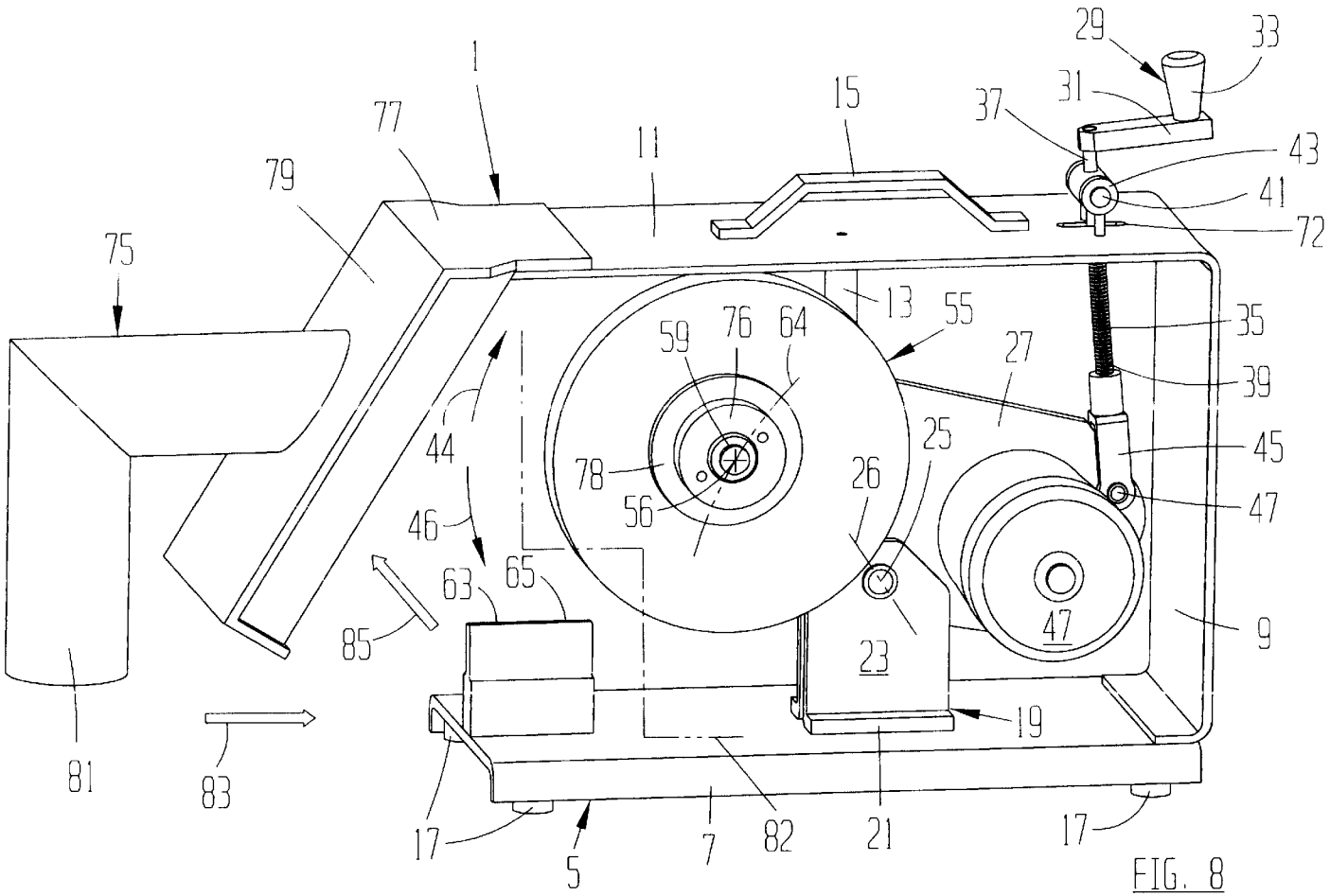
FIG. 8 is a perspective view of the front side of the blade sharpener of the invention.
Figure 9:
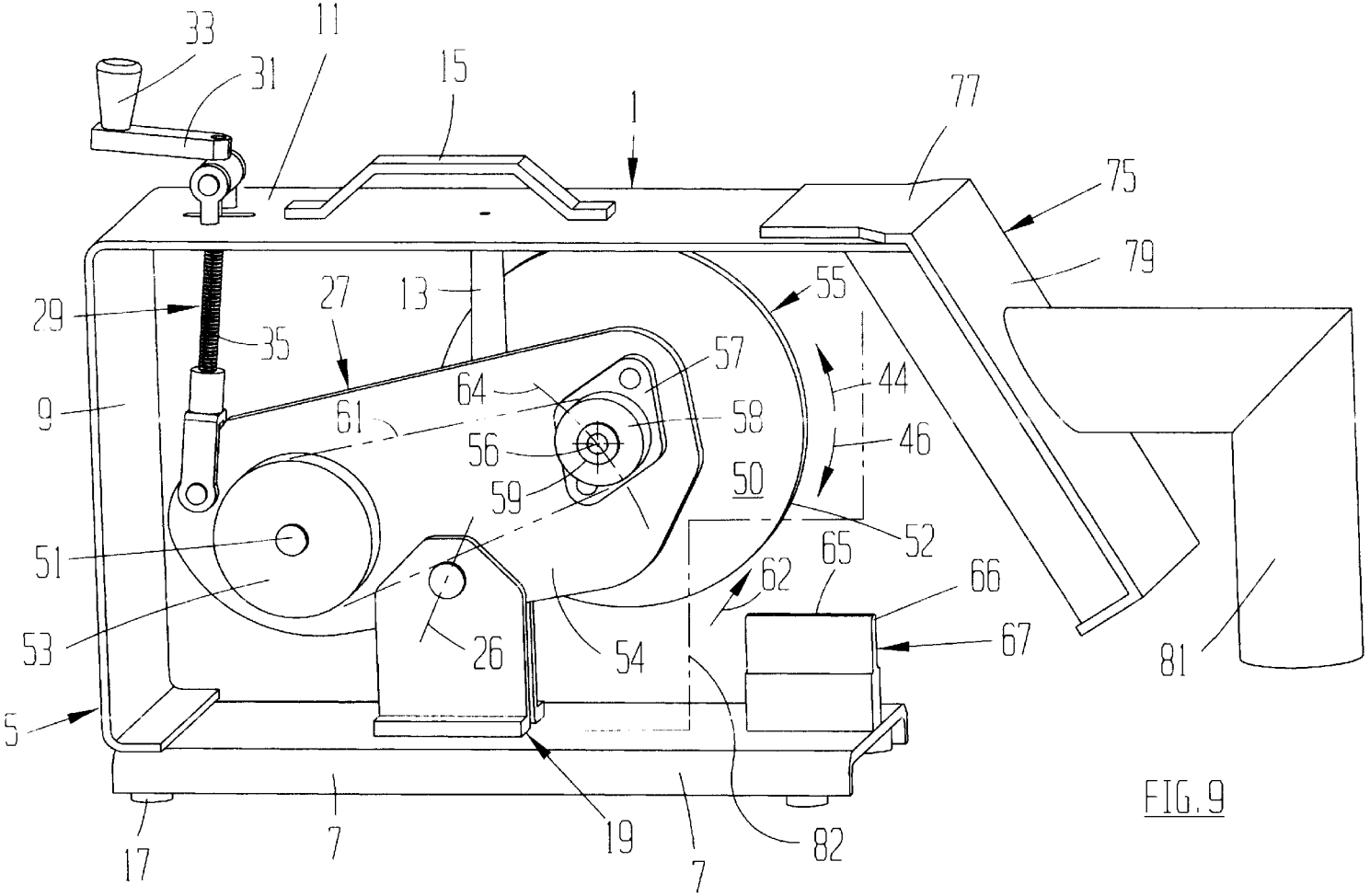
FIG. 9 is a perspective view of the back side of the blade sharpener.

Referring to FIGS. 8 and 9, a blade sharpener 1 is illustrated that includes the present invention. The blade sharpener 1 is particularly useful for sharpening blades, such as those typically represented at reference numeral 3 of FIGS. 1–3 and reference numeral 16 of FIGS. 4–7, of rotary lawn mowers. However, it will be understood that the invention is not limited to use with rotary cutting implements.

The blade sharpener 1 is comprised of a sturdy C-shaped frame 5 having a base 7, a back wall 9, and a top wall 11. A post 13 between the base 7 and the top wall 11 adds rigidity to the frame 5. The blade sharpener is easily portable by means of a handle 15 on the top wall and several rubber feet 17 on the underside of the base.

Upstanding from the top surface of the base 7 are a pair of brackets 19. As illustrated, each bracket 19 is L-shaped, having a short leg 21 that is fastened to the base and a vertical leg 23. A shaft 25 extends between the legs 23 of the brackets. The shaft 25 defines an axis 26 and pivotally supports a pivot plate 27.

Pivoting of the pivot plate 27 about the shaft 25 is achieved by an adjustment mechanism 29. In the preferred embodiment, the adjustment mechanism 29 is in the form of a crank 31 with a handle 33. The crank 31 receives a stud 35 that passes through a slot 72 in the frame top wall 11. The stud 35 has right-hand threads at one end 37 and left-hand threads at the other end 39. The threads at end 37 engage mating threads of a trunion 41. The trunion 41 is supported on the frame top wall by a pair of bearings 43. The stud end 39 engages a clevis 45. The clevis 45 is attached to the pivot plate by a swivel pin 47. It is thus seen that oppositely turning the crank 31 causes the pivot plate to pivot in the directions of arrows 44 and 46 about the shaft 25.

Secured to the pivot plate 27 close to the adjustment mechanism 29 is an electric motor 47. For example, a flange of the motor 47 may be secured to the pivot plate by fasteners, not shown. The motor armature shaft 51 extends through the pivot plate. A timing pulley 53 is connected to the motor shaft 51.

Figure 10:
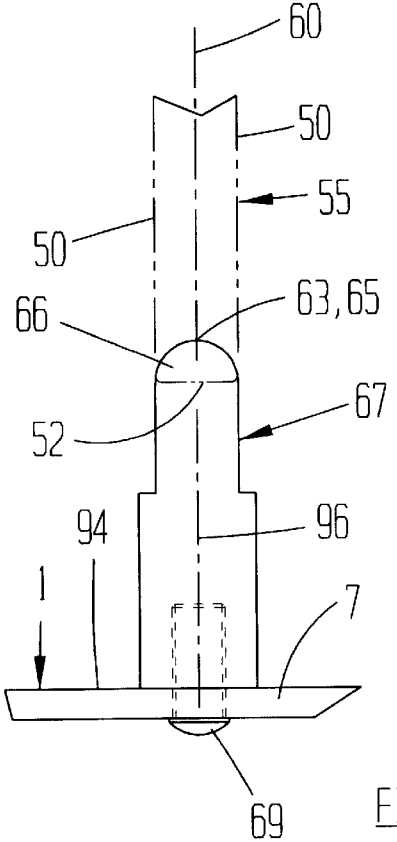
FIG. 10 is an end view of the single line work support and pedestal of the blade sharpener.

On the opposite end 54 of the pivot plate 27 as the adjustment mechanism 29 is a narrow grinding wheel 55. The grinding wheel 55 has a periphery 52 and two flat sides 50. As illustrated, the grinding wheel 55 is on the same side of the pivot plate as the motor 47. The grinding wheel is rotatably mounted to the pivot plate for rotation about an axis 56. The grinding wheel defines a transverse plane 60 that is perpendicular to the grinding wheel axis of rotation 56. Also see FIG. 10. The transverse plane 60 is approximately midway between the grinding wheel side surfaces 50.

Mounting of the grinding wheel 55 is preferably by a shaft 59 that rotates in a pair of flange bearings 57, one of which is secured to each side of the pivot plate 27. A threaded arbor 74 with a driving flange fits over and rotates with the shaft 59. The grinding wheel is clamped on the arbor 74 against the driving flange by an arbor nut 76 and spacer 78. The arbor driving flange conforms to American National Standards Institute specification B7.1-1988. A pulley 58 is connected to the shaft 59 on the opposite side of the pivot plate as the grinding wheel. The pulley 58 has a diameter that is preferably approximately 20 percent smaller than the motor pulley 53. A timing belt 61 is trained over the two pulleys 53 and 58. Accordingly, energizing the motor 47 causes the grinding wheel to rotate approximately 25 percent faster than the motor shaft 51. Rotation of the grinding wheel is unidirectional in the direction of arrow 62. It will be recognized that turning the adjustment mechanism crank 31 turns the stud 35 and causes the grinding wheel axis of rotation 56 to swing in the directions of the arrows 44 and 46 along an arcuate line 64.

According to an important aspect of the invention, the grinding wheel 55 is made of relatively soft materials. Specifically, the grinding wheel ceramic and binder are only slightly harder than the hardness of the steel of commercially important cutting blades. A preferred grinding wheel is one marketed by the Norton Company of Worchester, Mass., under model number 32A. Further, the width of the grinding wheel is relatively narrow compared to prior grinding wheels. For example, in a preferred embodiment of the blade sharpener 1, the grinding wheel width is approximately 0.50 inches.

The blade sharpener 1 further comprises a work surface 63. It is a feature of the invention that the work surface 63 is a single straight support line 65 that lies entirely in the transverse plane 60 the grinding wheel 55. The support line 65 is thus perpendicular to the shaft axis 26. Preferably, the support line 65 is a longitudinal line along a cylindrical surface. As illustrated, the support line lies along a semi-cylinder 66. The semi-cylinder 66 is part of a pedestal 67 that is mounted to the base 7 by fasteners 69.

In the particular construction illustrated, the pedestal 67 defines a pedestal plane 96 that contains the work support line 65. The pedestal plane 96 is perpendicular to the base plane 94.

Figure 11:
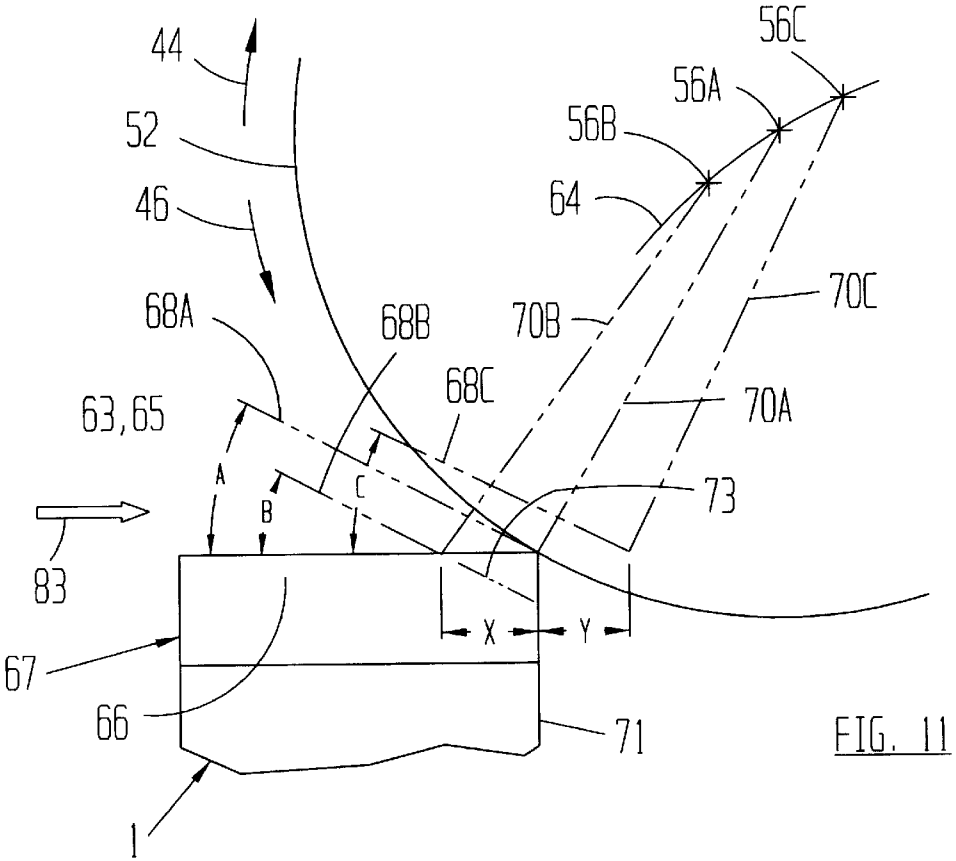
FIG. 11 is a schematic view showing the relation between the grinding wheel and the work surface according to the present invention.

As mentioned, turning the crank 31 of the adjustment mechanism 29 causes the axis of rotation 56 of the grinding wheel 55 to swing along the arcuate line 64. Turning to. FIG. 11, it is seen that the periphery 52 of the grinding wheel changes its spatial relation with the pedestal 67 as the pivot plate 27 pivots about the shaft 25 and the grinding wheel axis of rotation swings along the arcuate line 64. The blade sharpener 1 is designed such that the tangent 68A of a radius 70A of the grinding wheel makes a desired angle A with the work surface support line 65 when the grinding wheel periphery just contacts the inner end 71 of the work surface 63. In that situation, the grinding wheel axis of rotation is represented at reference numeral 56A.

To produce an angle B greater than angle A, the adjustment mechanism 29 is adjusted to pivot the pivot plate 27 and thus the grinding wheel axis of rotation 56, in the direction of arrow 46. Doing so swings the grinding wheel axis of rotation to a position 56B and also brings the grinding wheel periphery 52 into grinding contact with the semi-cylinder 66. The grinding wheel 55 cuts the semi-cylinder along line 73 back a desired amount X from the end 71. The tangent 68B of the grinding wheel radius 70B then makes the desired angle B with the work surface 63.

To produce an angle C less than angle A, the adjustment mechanism 29 is adjusted to pivot the pivot plate 27 in the direction of arrow 44 to a position 56C for the grinding wheel axis of rotation. That action moves the grinding wheel periphery 52 away from the work surface 63 by a distance Y. The tangent 68C of the grinding wheel radius 70C makes an angle C with an extension of the work surface straight line 65.

In the illustrated construction, the blade sharpener 1 includes a grit guard 75. The grit guard 75 has a top section 77 that is attached to the frame top wall 11. The top section 77 joins to an angled section 79 that terminates above the level of the frame base 7. A duct 81 opens into the angled section 79. The duct 81 is connectable via a hose or the like, not illustrated in the drawings, to an exhaust system.

Shields 82 of clear material, such as Lexan plastic, fit between the frame base 7 and the walls 9 and 11 on both sides of the blade sharpener 1. The shields 82 provide full access to the work surface 63 while preventing direct access to the grinding wheel 55, pulleys 53 and 58, and timing belt 61.

Figure 3:
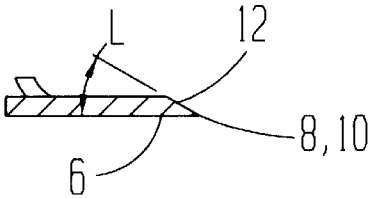
FIG. 3 is a cross-sectional view taken along line 3—3 of FIG. 2 and rotated 90 degrees clockwise.
Figure 6:
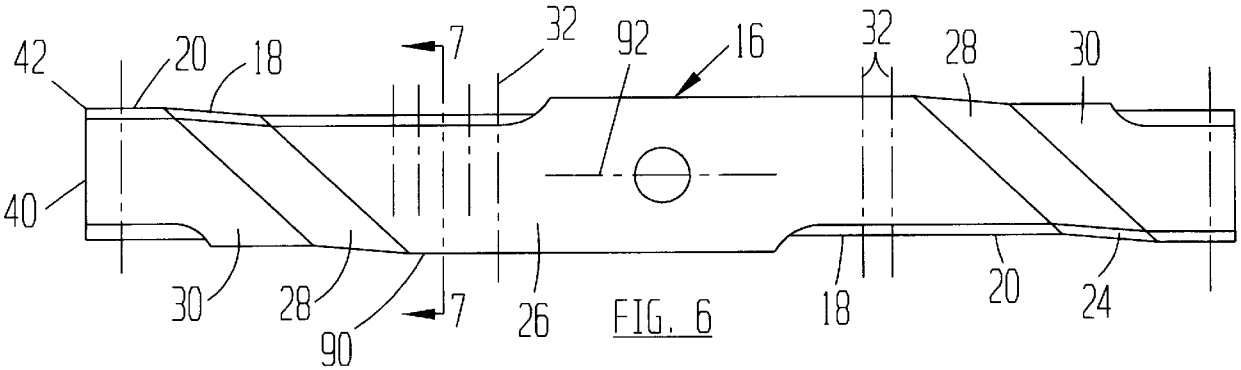
FIG. 6 is a top view of FIG. 5.
Figure 5:
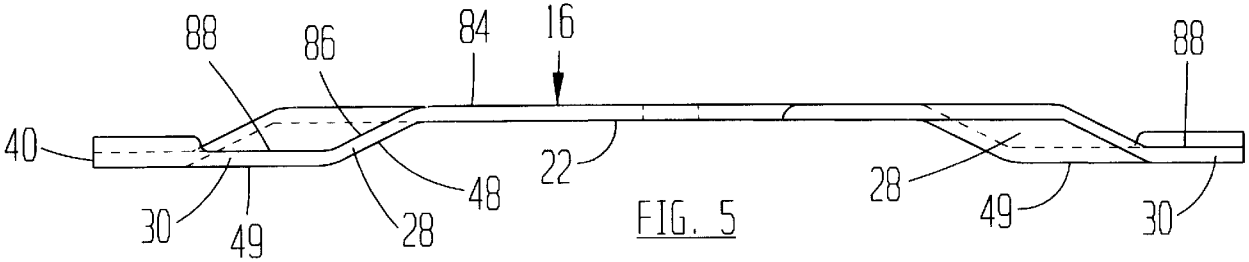
FIG. 5 is a front view of the mulching blade of FIG. 4.
Figure 4:
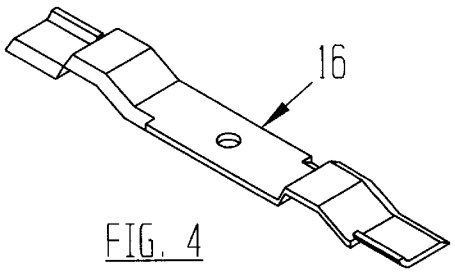
FIG. 4 is a perspective view of a typical mulching. blade that is efficiently sharpened on the blade sharpener of the invention.
Figure 7:
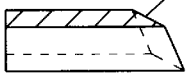
FIG. 7 is a cross-sectional view taken along line 7—7 of FIG. 6 and rotated 90 degrees clockwise.

To use the blade sharpener 1 to sharpen a straight edge blade 3, the adjustment mechanism 29 is adjusted to produce the desired cutting angle L, such as angles A, B, or C, on the blade cutting surfaces 12, FIG. 3. For example, the adjustment mechanism may be adjusted to pivot the pivot plate 27 to produce an angle between angles B and C, FIG. 11, equal to the desired angle L. The bottom surface 6 of the blade close to the tip 38 is laid on the work surface 63 with the cutting edge 8 out of contact with the grinding wheel 55. The blade is held such that its longitudinal centerline 4 is generally parallel to the grinding wheel axis of rotation 56. The blade is supported on the work surface along only one of the imaginary lines 14 on the blade bottom surface. However, the blade is supported for its full width between the cutting edge and the associated back edge 2. The blade is slowly fed crosswise in the direction of arrow 83 until the cutting edge contacts the grinding wheel 55 such that the grinding wheel removes the desired amount of material from the blade to produce the cutting surface 12 close to the tip. Then the blade is fed lengthwise in the direction of arrow 85 to produce the desired cutting surface 12 for the full length of the blade cutting edge. Feeding the blade in the direction of arrow 85 results in supporting the blade on constantly changing imaginary lines 14 on the blade bottom surface 6.

Figure 12:
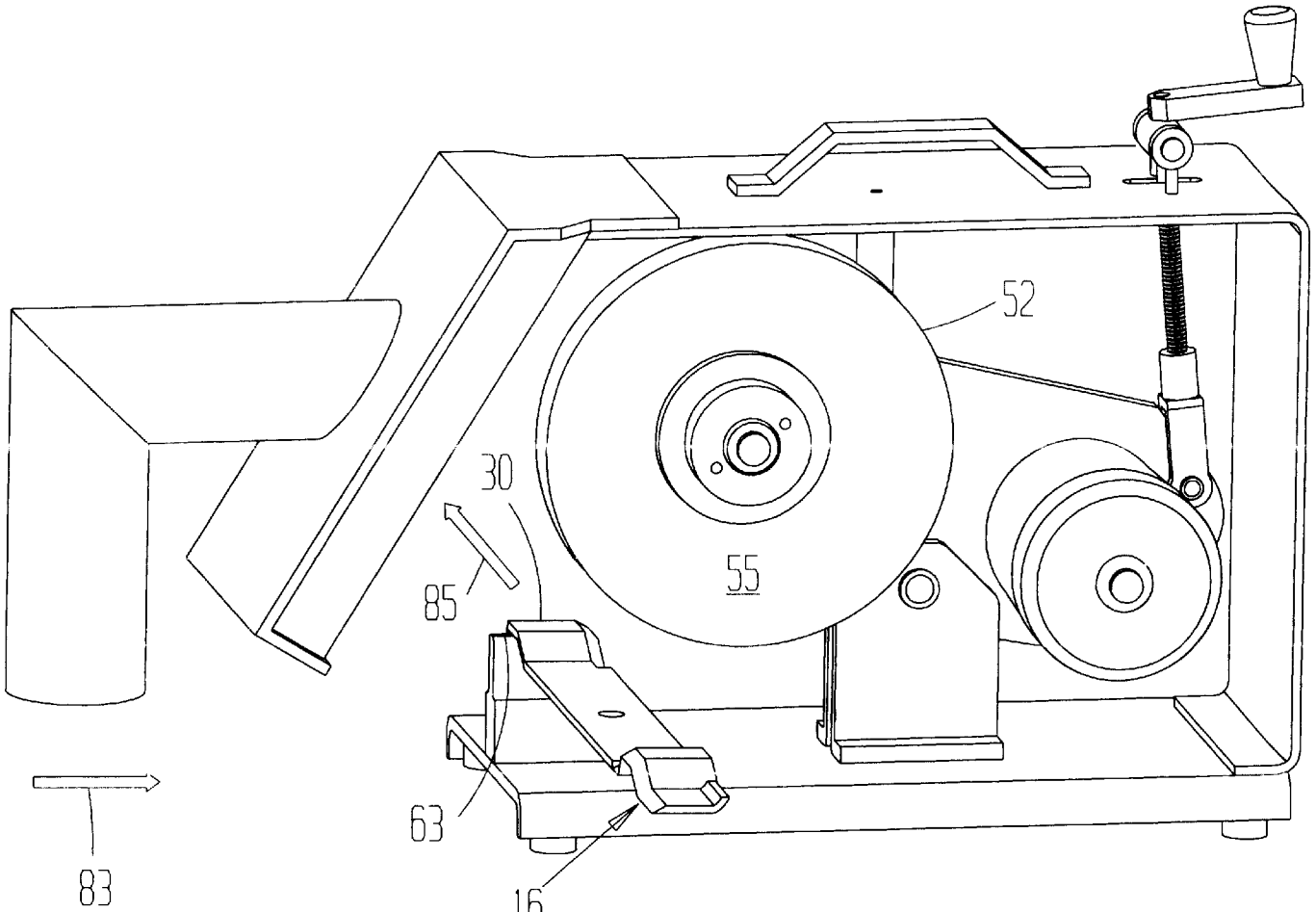
FIG. 12 is a view similar to FIG. 8, but showing a mulching blade being sharpened by the blade sharpener of the invention.

The blade sharpener 1 is particularly effective for sharpening mulching blades such as blade 16, FIGS. 4–7. Looking also at FIG. 12, the bottom surface 49 of the mulching blade end section 30 adjacent a tip 42 is laid on the work surface 63 out of contact with the grinding wheel 55. The mulching blade is supported only along one imaginary line 32. The blade is cross fed in the direction of arrow 83 to produce the proper cutting surface 24 adjacent the tip 42. The mulching blade is then fed lengthwise in the direction of arrow 85 to sharpen the cutting edge 18 of the section 30. When the blade angled section 28 reaches the work surface, the blade becomes supported by only one imaginary line 32 along the angled section bottom surface 48. Consequently, little, if any, angular movement of the mulching blade in space is required to maintain proper contact between the grinding wheel and the blade. The narrow width of the grinding wheel further contributes to the efficient and proper grinding of the cutting edge at the transition between the blade end and angled sections. When the blade center section 21 reaches the work surface, the bottom surface 26 smoothly slides onto the work surface without requiring any angular movement of the blade in space. The cutting edge at the transition between the angled section and the center section 22 is therefore properly sharpened with ease. In general, the blade rises and falls in space during lengthwise feeding, but the single line support of the blade on the work surface eliminates most, if not all, angular movements of the blade during the sharpening process. Further, the same cutting angle is produced on the cutting edges of all the blade sections.

An outstanding advantage of the blade sharpener 1 is that the blade being sharpened is supported on the work surface 63 very close to the grinding wheel periphery 52. In fact, for cutting angles greater than angle A (FIG. 11), the blade is supported fully up to the cutting edge itself. For blade 3, for example, the blade is supported along the imaginary lines 14 up to the cutting edge 8. For cutting angles less than angle A, there is a short distance Y from the cutting edge that is not supported. A typical unsupported distance Y is quite small, being in the range of approximately 0.30 inches to 0.40 inches. Compared with the proportion of the total blade width between the cutting edge and the back edge that is supported on the work surface, the unsupported length Y is not detrimental to sharpening performance.

During the sharpening process, grit and metallic particles travel tangentially from the grinding wheel periphery 52 toward the grit guard 75. A source of vacuum connected to the duct 81 draws the grit and particles through the duct and to a collection location. Because of the relatively high speed of the grinding wheel 55 and its relatively soft composition, the grinding wheel removes metal from the blade in a true cutting fashion. The grinding wheel thus very rapidly removes material from the blade but does not load up with burned particles of metal. Consequently, dressing the grinding wheel is rarely, if ever, required.

Figure 13:
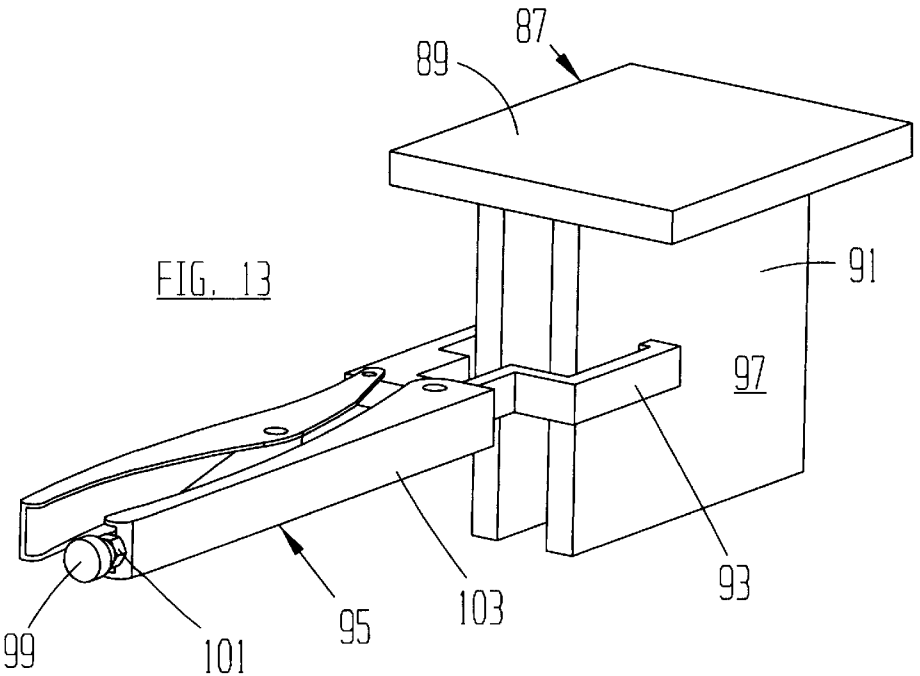
FIG. 13 is a perspective view of a mobile work table for the blade sharpener.

Further in accordance with the present invention, the work surface 63 with the single support line 65 can be replaced by a work surface having a finite flat area. Turning to FIG. 13, a mobile work table 87 has a flat top plate 89 and two depending lugs 91. The height of the lugs 91 is slightly greater than the height of the pedestal 67. The space between the lugs 91 is slightly greater than the width of the pedestal Jaws 93 of a manually actuated clamp 95 are welded or otherwise permanently joined to the opposite facing sides 97 of the lugs 91. The amount of gripping force producible by the clamp 95 is adjustable by a screw 99. A nut 101 on the screw 99 is lockable against a fixed member 103 of the clamp. The nut 101 is set to produce a repeatable force by the jaws 93 on the lugs.

Figure 14:
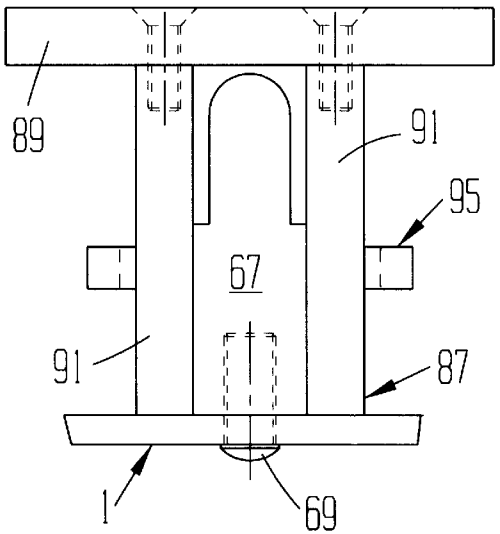
FIG. 14 is an end view showing the mobile work table retained to the blade sharpener.
Figure 15:
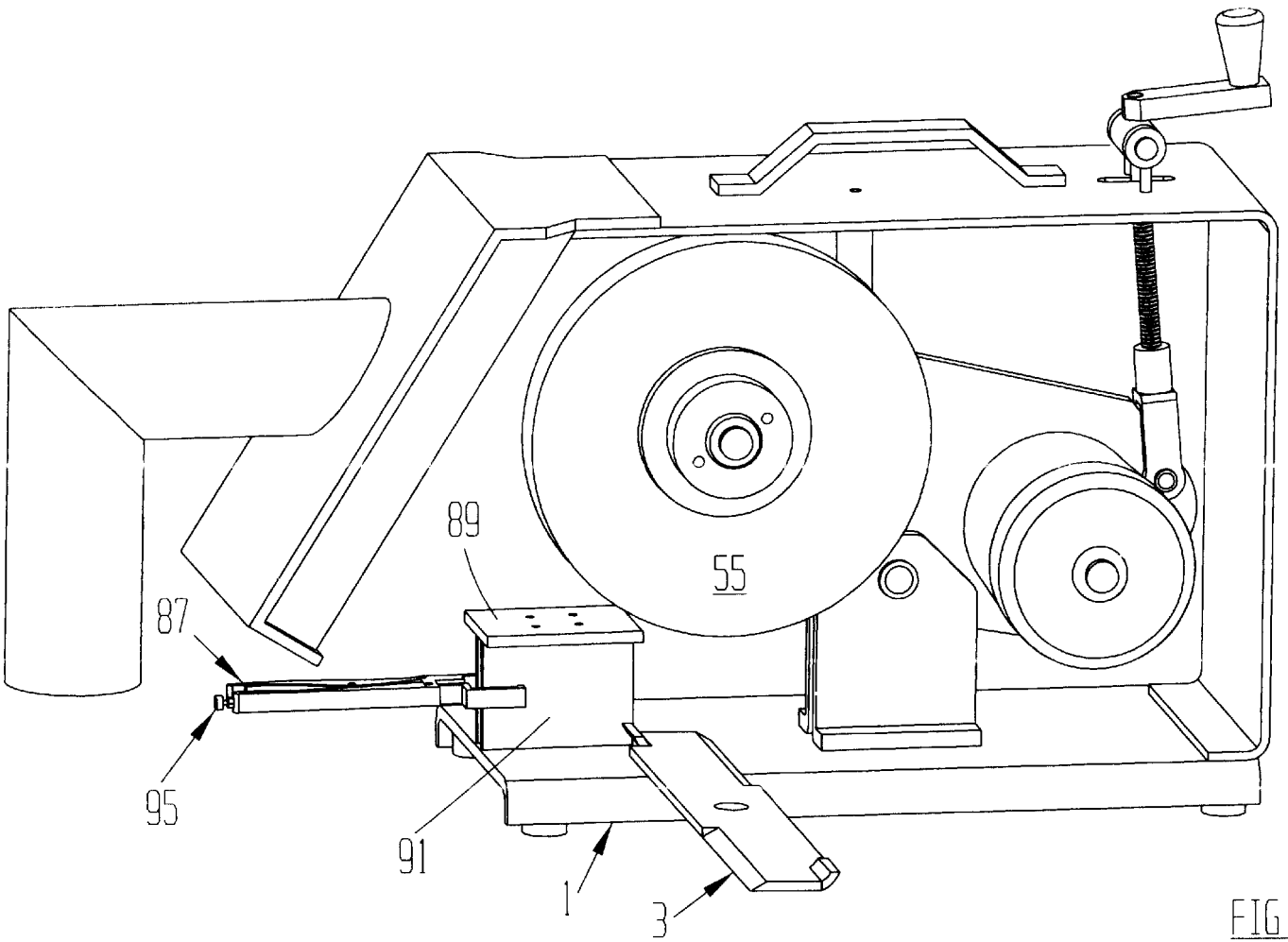
FIG. 15 is a perspective view showing a straight blade being sharpened using the mobile work table of the invention.

FIGS. 14 and 15 shows the mobile work table 87 in place over the pedestal 67 on the blade sharpener 1. The mobile work table lugs 91 are placed alongside the pedestal. Actuating the clamp 95 causes the lugs to tightly squeeze the pedestal 67 and thereby retain the mobile work table to the pedestal. The mobile work table top plate 89 is used for sharpening flat workpieces, such as blade 3, that remain in a single plane as they are fed past the grinding wheel 55. The mobile work table is easily removable from the pedestal by releasing the clamp 95 when it is desired to sharpen a mulching blade 16 (FIGS. 4–7).

In summary, the results and advantages of cutting blades for rotary power mowers and the like can now be more fully realized. The blade sharpener 1 provides both rapid sharpening of the blades as well as convenient adjusting of the blade cutting angle. This desirable result comes from using the combined functions of the work surface 63 and the adjustment mechanism 29. The work surface is in the form of a straight support line 65 that supports a blade only along one line of the blade at a time. A mulching blade rises and falls relative to the grinding wheel with minimum if any angular motions in space as different sections of the mulching blade are fed past the grinding wheel. Depending on the cutting angle produced on the blade as set by the adjustment mechanism, the blade may be supported for its full width along the bottom surface. A mobile work table 87 having a flat top surface area is removeably retainable over the pedestal 67 that contains the work surface support line. The combination of the relatively fast speed of the grinding wheel 55 and its relatively soft composition enables rapid blade sharpening without burning the blade or loading the grinding wheel.

It will also be recognized that in addition to the superior performance of the blade sharpener 1, its construction is such as to significantly reduce the cost of manufacture as compared to traditional blade sharpening machines. Also, since the blade sharpener is made of a simple design and with rugged components, the need for maintenance is minimal.

Thus, it is apparent that there has been provided, in accordance with the invention, a blade sharpener for curved and straight edge blades that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. In combination:

a. a blade sharpener comprising:

i. a frame;

ii. a grinding wheel supported on the frame for rotating about an axis of rotation, the grinding wheel defining a transverse plane that is perpendicular to the axis of rotation; and iii. a work surface mounted on the frame and consisting of a single support line that lies substantially entirely in the grinding wheel transverse plane; and b. a blade having opposed top and bottom surfaces, at least one cutting edge that intersects the bottom surface, and a back edge opposite said at least one cutting edge, the blade defining a longitudinal centerline substantial parallel to said at least one cutting edge, the blade bottom surface defining a multiplicity of imaginary lines that are substantially perpendicular to the cutting edge, the blade bottom surface being supported on the support line with the blade longitudinal centerline and said at least one cutting edge substantially perpendicular to the support line and parallel to the grinding wheel axis of rotation, so that the blade cutting edge is sharpenable by feeding the blade in a direction parallel to the longitudinal centerline thereof and perpendicular to the support line.

2. The combination of claim 1 wherein the frame comprises:

a. an end wall and a top wall that cooperate with the base to form a generally C-shaped frame; and b. a post between the base and the top wall that provides rigidity to the frame.

3. The combination of claim 2 further comprising al handle on the top wall that enables the blade sharpener to be manually carried for operation at different selected locations.

4. The combination of claim 2 further comprising a grit guard having a top section attached to the frame top wall, and an angled section depending from the top section, the angled section having a duct connectable with a source of vacuum, the grit guard top section and angled section being located to receive grit and particles from the blade when sharpened by the blade sharpener.

5. The combination of claim 1 further comprising means for pivoting the grinding wheel axis of rotation about a first axis that is parallel to the grinding wheel axis of rotation.

6. The combination of claim 5 wherein the means for pivoting the grinding wheel axis of rotation comprises:

a. at least one bracket upstanding from the frame and defining the first axis; and b. a pivot plate that supports the grinding wheel and having first and second ends and that is connected to said at least one bracket for pivoting about the first axis.

7. The combination of claim 6 further comprising means for pivoting the pivot plate to enable the grinding wheel to cooperate with the work surface to produce a selected cutting angle on the blade supported on the work surface.

8. The combination of claim 6 further comprising an adjustment mechanism operatively associated with the frame and the pivot plate first end, the pivot plate pivoting about the first axis in response to operation of the adjustment mechanism.

9. The combination of claim 1 wherein the work surface support line lies along a pedestal upstanding from the frame, and wherein the blade sharpener further comprises a mobile work table selectively retainable on and removable from the pedestal.

10. The combination of claim 9 wherein the mobile work table comprises:

a. a top plate;

b. a pair of lugs depending from the top plate; and c. clamp means for selectively clamping against the lugs, the lugs being placeable alongside the pedestal and clampable by the clamp means to retain the mobile work table to the pedestal.

11. The combination of claim 1 wherein:

a. the frame comprises a base that defines a base plane that is parallel to the grinding wheel axis of rotation;

b. the work support line lies along a pedestal upstanding from the base; and c. the pedestal defines a pedestal plane that passes through the work support line and that is substantially perpendicular to the base plane and that is coplanar with the grinding wheel transverse plane.

12. The combination of claim 1 wherein the support line supports the blade bottom surface only along a single one of the imaginary lines between the blade cutting edge and the back edge.

* * * * *